US006531842B2

(12) United States Patent
LeDoux et al.

(10) Patent No.: US 6,531,842 B2
(45) Date of Patent: Mar. 11, 2003

(54) SINE WAVE VARIABLE SPEED DRIVE

(75) Inventors: Kurt LeDoux, Houston, TX (US); William C. Pelton, Bartlesville, OK (US)

(73) Assignee: Schlumberger Technology Corp., Sugar Land, TX (US)

( * ) Notice: Subject to any disclaimer, the term of this patent is extended or adjusted under 35 U.S.C. 154(b) by 0 days.

(21) Appl. No.: 09/888,746

(22) Filed: Jun. 25, 2001

(65) Prior Publication Data

US 2002/0195988 A1 Dec. 26, 2002

(51) Int. Cl.[7] ..... G05B 11/01

(52) U.S. Cl. ..... 318/629; 318/3; 318/11; 318/632; 417/44.1; 417/45; 417/293; 417/321

(58) Field of Search ..... 318/629, 632, 318/3, 11, 801; 417/44.1, 45, 293, 321

(56) References Cited

U.S. PATENT DOCUMENTS 3,610,779 A * 10/1971 Hubby ..... 417/5
3,876,923 A * 4/1975 Humphrey et al. ..... 321/27 R
3,940,669 A 2/1976 Tsuboi et al.
3,991,354 A 11/1976 Rosa et al.
4,307,324 A 12/1981 Regnier
4,437,050 A 3/1984 Overzet
4,547,719 A 10/1985 Sakamoto et al.
4,652,989 A 3/1987 Kurosawa et al.
5,016,158 A * 5/1991 Matsui et al. ..... 363/71
5,206,575 A 4/1993 Nakamura et al.
5,234,319 A * 8/1993 Wilder ..... 417/40
5,318,409 A * 6/1994 London et al. ..... 417/53
5,444,344 A 8/1995 Vincent
5,483,140 A 1/1996 Hess et al.
5,495,918 A 3/1996 Peruggi et al.
5,542,501 A 8/1996 Ikejima et al.
5,585,708 A 12/1996 Richardson et al.
5,747,963 A 5/1998 Visinka
5,764,022 A 6/1998 Kazama et al.
5,808,437 A 9/1998 Schob
5,844,397 A * 12/1998 Konecny et al. ..... 318/811
5,923,144 A 7/1999 Seibel et al.
5,945,802 A * 8/1999 Konrad et al. ..... 318/807
6,008,617 A 12/1999 Kaneko et al.
6,018,224 A 1/2000 Cocconi
6,070,760 A * 6/2000 Kenney et al. ..... 222/55

OTHER PUBLICATIONS

Pelton, Bill; Ledoux, Kurt; Kelly, Don; Voltage Stresses in Electric Submergible Pumps Operated by Variable Speed Drives; Electric Submergible Pump Workshop, Apr., 28–30, 1999; pp. 1–17.

* cited by examiner

*Primary Examiner*—Robert E. Nappi
*Assistant Examiner*—Rina I. Duda
(74) *Attorney, Agent, or Firm*—Fletcher, Yoder & Van Someren; Jeffrey Griffin; Brigitte Jeffery

(57) ABSTRACT

The present technique utilizes already existing components within a variable speed drive to provide harmonic filtering characteristics. Particularly, the present technique integrates transformers and inductors to provide a filter within the variable speed drive. Further, the present technique may also utilize a sine wave filter to provide additional filtering of unwanted frequencies.

23 Claims, 3 Drawing Sheets

SINE WAVE VARIABLE SPEED DRIVE

FIELD OF THE INVENTION

The present invention relates generally to variable speed drives. More particularly, the present invention relates to the reduction of harmonics produced by a variable speed drive through a modulation scheme.

BACKGROUND OF THE INVENTION

This section is intended to introduce the reader to various aspects of art, which may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Variable speed drives are used to drive a variety of electric motors. One exemplary application is to drive a submersible motor used in an electric submersible pumping system. A typical system comprises a pump, an electric motor and a motor protector deployed in a wellbore. The submersible motor can be used to power components, such as the pump, to permit pumping of the production fluids to the surface or some point above the surface of the earth. A typical submersible motor, used to pump production fluids from beneath the earth's surface, has an outer housing substantially sealed from the production fluid environment and sized to fit within standard wellbore casings. An exemplary submersible motor is a three-phase induction-type motor, having a shaft rotatably mounted within the housing such that it is in general alignment with the axis of the wellbore when residing in the wellbore.

Power may be supplied to the submersible electric motor via a power cable that runs along the deployment system. Typically, the power cable is banded or supported along either the outside or the inside of the deployment system. Generally, the power cable is routed to the electric motor to supply electric power thereto, and the submersible pump is powered by the motor by way of an appropriate drive shaft.

A variable speed drive may be used to control the speed at which the motor operates and to facilitate an overall increase in efficiency of operation. However, variable speed drives can create undesirable harmonics. For example, certain harmonics created by the operation of the motor cause problems such as voltage distortion, zero-crossing noise, overheating of transformers, nuisance tripping of circuit breakers, and over-stressing of power factor correction capacitors. The lower harmonics are particularly troublesome because they are larger, therefore less attenuated by the system impedance and more difficult to remove at the source. Additional losses arise due to the production of harmonic generated fields. Furthermore, harmonics, whether propagated or not, cause increased losses in the transformer windings and core. Presently, separate components such as filters and inverters are used to reduce the amount of harmonics in the signal output by the variable speed drive. Although, this solution produces some results, the filter components are separate from the variable speed drive. Additionally, there are still harmonics produced that are not filtered out by these components. These harmonics remain to produce the aforementioned undesirable affects.

SUMMARY OF THE INVENTION

Certain aspects commensurate in scope with the originally claimed invention are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

An aspect of the present technique provides a variable speed drive output with reduced harmonic components. In this embodiment, certain components of the variable speed drive are integrated so that a sine wave output is produced with a reduced amount of harmonic components. More particularly, certain variable speed drive components that have filtering characteristics may be utilized to filter out harmonic components in a sine wave output. Thus, an electric motor can be operated efficiently without the detrimental introduction of harmonics into the system.

In another aspect of the present technique, a variable speed drive having a plurality of three phase inverters are integrated with inductors and a sine wave filter to produce a sine wave output having reduced harmonic components. The inverters and inductors are integrated in a way so that they perform functions similar to the sine wave filter. Consequently, the use of the integrated variable speed drive features along with the sine wave filter facilitates the production of a cleaner sine wave output.

BRIEF DESCRIPTION OF THE DRAWINGS

The invention will hereafter be described with reference to the accompanying drawings, wherein like reference numerals denote like elements, and.

DESCRIPTION OF SPECIFIC EMBODIMENTS

One or more specific embodiments of the present invention will be described below. It should be appreciated that in the development of any such actual implementation, as in any engineering or design project, numerous implementation-specific decisions must be made to achieve the developers' specific goals, such as compliance with system-related and businessrelated constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
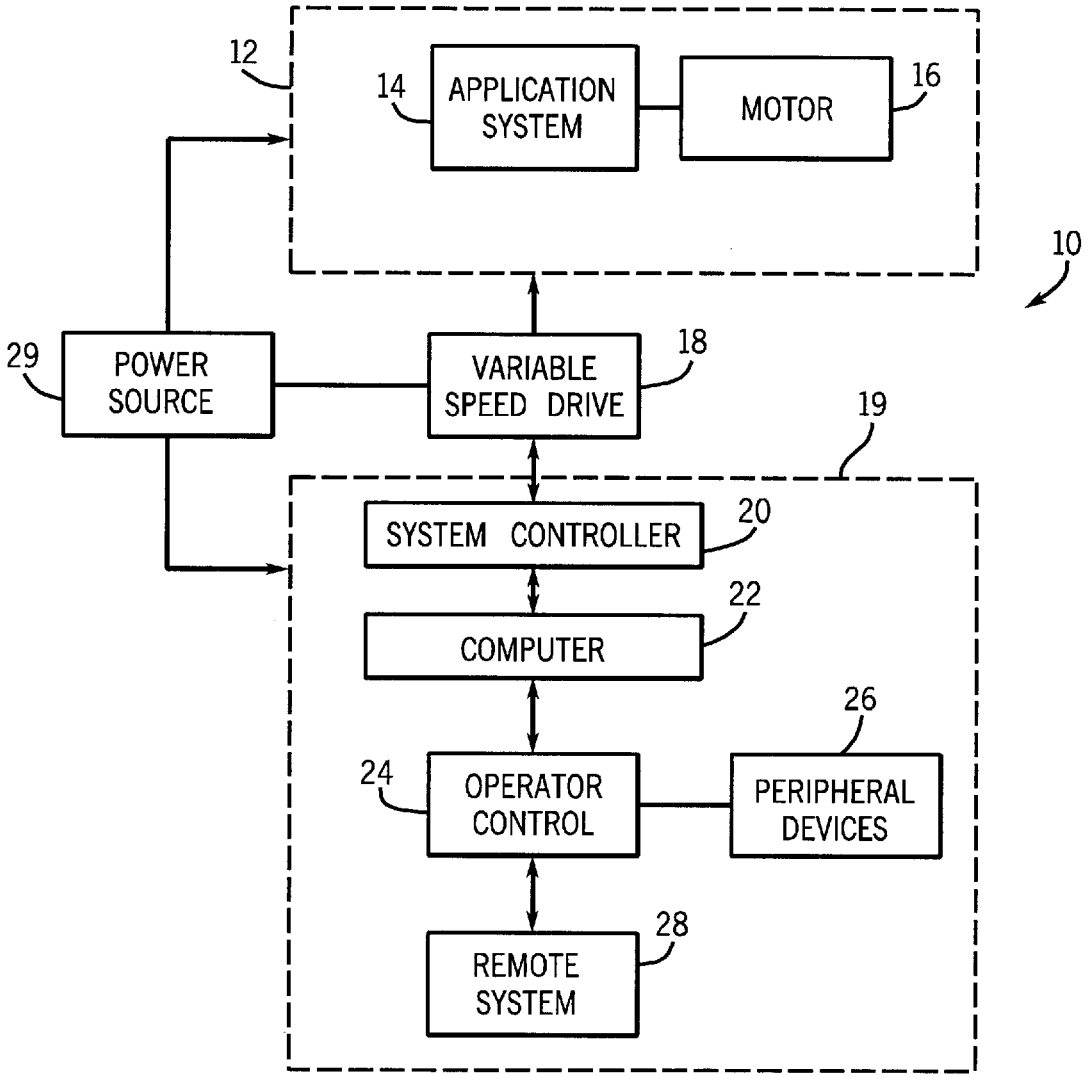
FIG. 1 is a system diagram according to an exemplary embodiment of the present technique.

Turning to FIG. 1, a typical operating system 10 is illustrated. It should be noted that the operating system 10 may be used to control a variety of motors and systems, such as electric submersible pumping systems. Particularly, an operating assembly 12 is illustrated having an application system 14 coupled to a motor 16. It should be noted that the motor 16 may be any type suitable for the application assembly 14. Further, the application system 14 may be applicable to any system having the motor 16. For example, the application system 14 may be an electric submersible pumping system.

In the present embodiment, a variable speed drive 18 is generally coupled to the motor 16. Further, the variable speed drive 18 is also coupled to a control assembly 19. The control assembly 19 typically comprises a plurality of elements to operate the operating assembly 12. Thus, the control assembly 19 may comprise computers, system controllers, and other such devices. In this embodiment, the variable speed drive 18 is directly coupled to a system controller 20. It should be noted that, although, the variable speed drive is illustrated as being coupled to a system controller 20, the variable speed drive 18 may be coupled to various other elements. For instance, the variable speed drive 18 may be directly coupled to a computer 22. However, in the illustrated embodiment, the system controller 20 is coupled to the computer 22, which is further coupled to an operator control system 24. The operator control system 24 is coupled to a series of peripheral devices 26. The peripheral devices 26 may comprise a keyboard, a printer, a display and other such devices. Additionally, the operator control system 24 may be controlled by a remote system 28. The operator control system 24 typically is controlled by an operator or by a series of instructions such as programs implemented in the computer 22. Further, a power source 29 is coupled to the operating assembly 12, the control assembly 19 and the variable speed drive 18.

Figure 2:
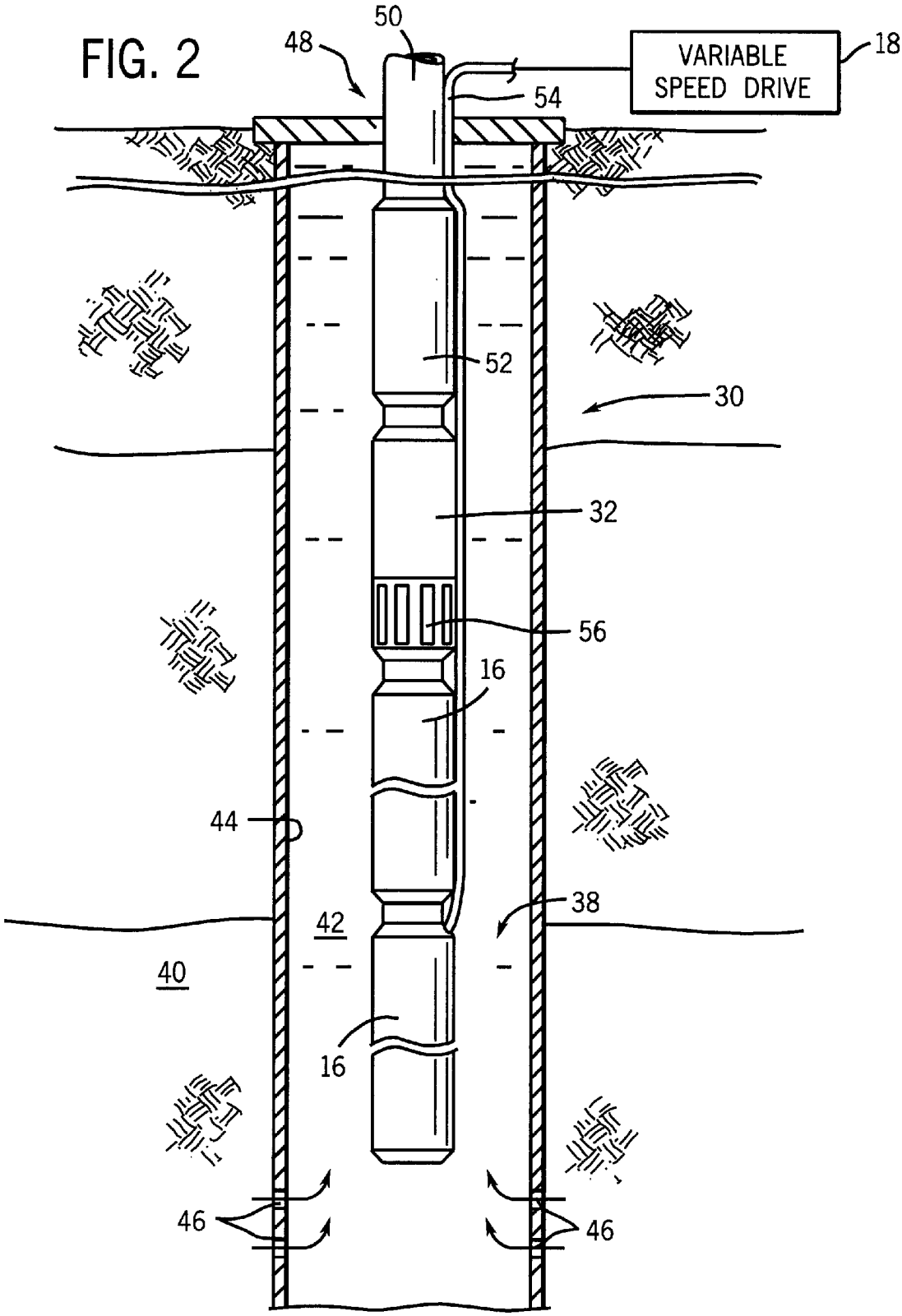
FIG. 2 is front elevational view of an electric submersible pumping system, according to an exemplary embodiment of the present technique.

Referring generally to FIG. 2, an exemplary application system 14 is illustrated in the form of an electric submersible pumping system 30. Pumping system 30 may comprise a variety of components depending on the particular application or environment in which it is used. The system 30 includes at least one centrifugal pump 32 coupled to motor 16, and a motor protector 36 under the control of variable speed drive 18.

In the illustrated example, pumping system 30 is designed for deployment in a well 38 within a geological formation 40 containing desirable production fluids, such as petroleum. In a typical application, a wellbore 42 is drilled and lined with a wellbore casing 44. Wellbore casing 44 may include a plurality of openings 46 through which production fluids flow into wellbore 42.

Pumping system 30 is deployed in wellbore 42 by a deployment system 48 that can have a variety of forms and configurations. For example, deployment system 48 may comprise tubing 50 connected to pump 32 by a connector 52. Power is provided to submersible motor 16 via a power cable 54. Motor 16, in turn, is controlled by the variable speed drive 18 and powers the centrifugal pump 32 which draws production fluid in through a pump intake 56 and pumps the production fluid to the surface via tubing 50. Additionally, the production fluids may be pumped to the surface through tubing 50 or through the annulus formed between deployment system 48 and wellbore casing 44. It should be noted that the illustrated submersible pumping system 30 is merely one exemplary embodiment. For instance, a horizontal pumping system may be an alternate embodiment.

It is generally appreciated by those skilled in the art that harmonic stresses produced by a variable speed drive cause problems in motors and especially those used in electrical submersible pumping systems. Further, these harmonic stresses may also cause problems with cables, penetrators and transformers. The present technique provides a method for reducing these harmonic stresses generated by the variable speed drive.

Conventional electric submersible pumping systems comprise components such as stepup transformers and cables with considerable amounts of capacitance and inductance and small amounts of resistance. As can be appreciated by those skilled in the art, when these components exist in the same circuit, a natural resonance condition occurs. This natural resonance condition causes voltage ringing to occur which produces undesirable effects such as harmonics. Thus, an output of the variable speed may include these undesirable components.

Also, a carrier frequency produced by the variable speed drive can introduce detrimental harmonic effects to the system. Typically, the higher the carrier frequency, the greater the spread between the harmonics generated. However, utilizing a filter when the carrier frequency is higher allows the sinusoidal voltage to be cleaner when it is output. The harmonic voltages do not contribute to the motor power output, but instead produce wasted volt amperes. Thus, one way of reducing the voltage stresses such as harmonics in a submersible pumping system is to filter the output of the variable speed drive. As mentioned above, in prior systems a filter is utilized to extract the harmonics from the output. In the present technique, however, the harmonics produced by the variable speed drive 18 are extracted using components within the variable speed drive 18, rather than having an additional filter. However, in certain applications, a filter may also be used in combination with the filtering capability of variable speed drive 18 to extract harmonics from the voltage output. Implementation of the present technique where the variable speed drive itself acts as a filter allows for a more economical system.

Figure 3:
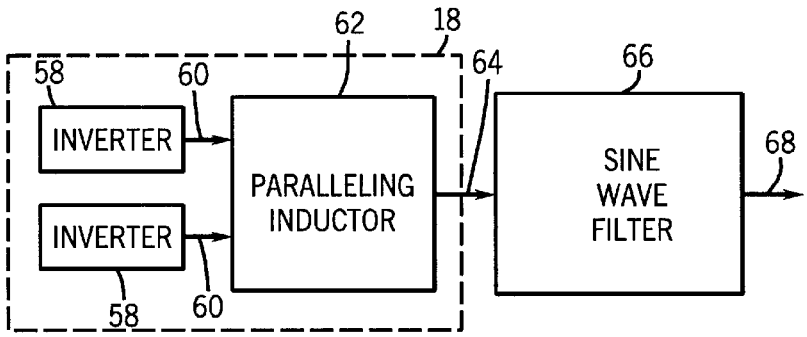
FIG. 3 is a block diagram of an exemplary method to reduce harmonics produced by a variable speed drive.

FIG. 3 illustrates an implementation of the present technique to provide an optimum sine wave output from variable speed drive 18. The exemplary variable speed drive 18 comprises components such as single bridge inverter, stepup transformers and inductors that are utilized in a manner that filters unwanted harmonics. Additional components such resistors may also be utilized to generate an output. In the present embodiment, the variable speed drive 18 is illustrated having a plurality of single bridge inverters 58. Typically, a power source (not shown) produces a frequency that is input to the three phase single bridge inverters 58. The inverters 58 convert DC signals to AC signals through a switching method.

The single bridge inverters 58 are typically configured in parallel to provide a greater output from the variable speed drive 18. As a result of the greater output, the motor 16 is provided with increased power. The increased power generally corresponds to a greater number of single bridge inverters 58 in the variable speed drive 18. Thus, an output AC signal 60 is transmitted from the inverters 58 into a series of parallel inductors 62 that are typically placed in parallel within the variable speed drive 18, so that the inductance within the drive 18 may be reduced. Consequently, a signal 64 is output from the parallel inductors 62 with reduced inductance. Optionally, the signal 64 may be transmitted to a sine wave filter 66, which filters out other or additional harmonic components from the signal 64.

In the present technique, the inductance provided by the parallel inductors 62 is utilized to extract harmonic components from the output signal 60. In other words, the parallel inductors 62 are utilized as components for filtering out unwanted frequencies. For example, the parallel inductors 62 provide an inductance similar to inductors otherwise provided in a conventional sine wave filter 66. The variable speed drive inductance is used to filter out the harmonics from the output 60 produced by the single bridge inverters 58. As a result, no separate filter or a less complex and less expensive sine wave filter 66 may be used, e.g. filter 66 may have a reduced number of inductors.

Figure 4:
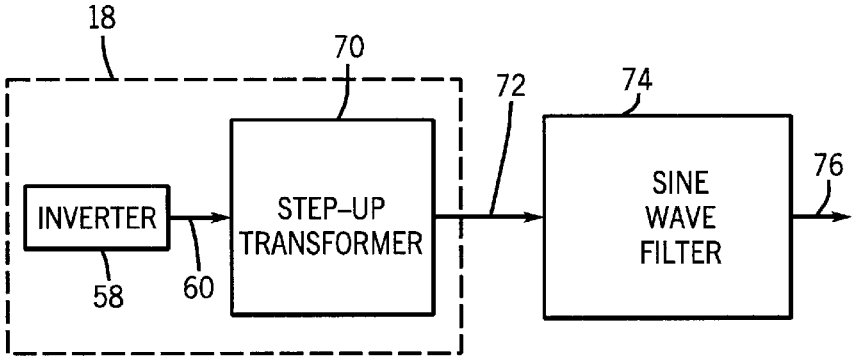
FIG. 4 is a block diagram of an alternative exemplary technique to reduce harmonics produced by the variable speed drive.

FIG. 4 illustrates an alternative embodiment, wherein the single bridge inverter 58 may be coupled to a step-up transformer 70 within the variable speed drive 18. As mentioned above, the single bridge inverter 58 converts the DC signal to the AC signal 60. In the present embodiment, the signal 60 is transmitted to the step-up transformer 70, which increases the voltage output. The step-up transformer outputs the increased voltage signal 72 to an optional sine wave filter 74, which transmits a sine wave output 76 to the motor 16.

It should be noted that the step-up transformer 70 produces a leakage inductance that serves as a filter inductance to permit use of the step-up transformer 70 as a filter component. As a result, all of the components designed within the variable speed drive 18 may be integrated to provide filtering qualities, thereby permitting omission of a separate sine wave filter or at least the use of a less expensive sine wave filter to filter out the remaining harmonics produced by the variable speed drive 18. For example, optional sine wave filter 74 is less complex, e.g. fewer inductors, resulting in a less expensive filter.

Figure 5:
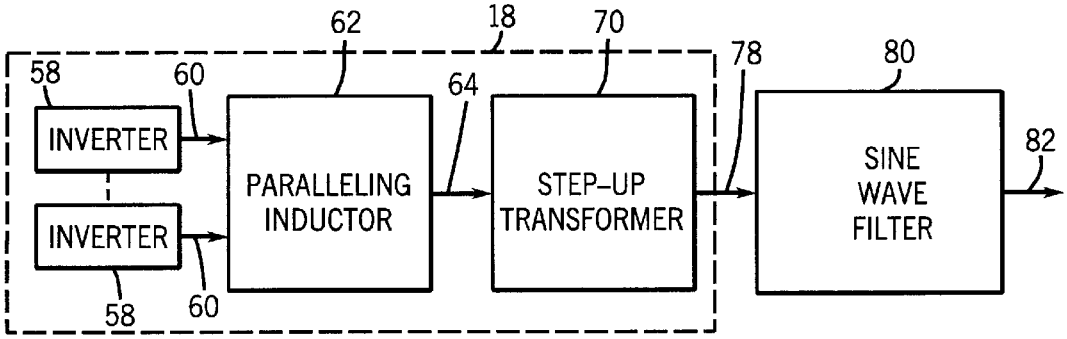
FIG. 5 is a block diagram of another alternative exemplary technique for reducing harmonics produced by the variable speed drive.

FIG. 5 illustrates an alternative embodiment wherein the components described in FIG. 3 and 4 are integrated to produce effects similar to those generated by a conventional sine wave filter. Particularly, the plurality of single bridge inverters 58 in parallel are coupled to parallel inductors 62. Furthermore, the parallel inductors 62 are coupled to the step-up transformer 70 within the variable speed drive 18. An output signal 78 may be transmitted to an optional sine wave filter 80. As mentioned above, the parallel inductors 62 provide inductance and the step-up transformer 70 provides additional leakage inductance, which may be used as filtering components to extract harmonics from the output signal 78 produced by the variable speed drive 18. This combination again results in the ability to omit a separate filter or to utilize a less complex sine wave filter 80.

It should be further noted that the multiple windings on the transformer 70 also can be utilized to eliminate the parallel inductors 62. As can be appreciated by those skilled in the art, the additional windings within the transformer 70 provide a similar output as the parallel inductors 62. Additionally, the increased switching of the single bridge inverters 58 may increase the carrier frequency produced by the variable speed drive 18. As mentioned above, the harmonics associated with higher carrier frequencies are easier to filter, resulting in the ability to use a less complex and less expensive sine wave filter with the overall system.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. An electric submersible pumping system, comprising:

a pump for displacing fluids within the well;

a submersible electric motor coupled to the pump to drive the pump; and a variable speed drive coupled to the submersible electric motor, the variable speed drive being configured to provide to the submersible electric motor a synthesized sine wave output with reduced detrimental harmonic components.

2. The submersible pumping system as recited in claim 1, wherein the variable speed drive comprises a plurality of single bridge inverters.

3. The submersible pumping system as recited in claim 2, wherein the variable speed drive further comprises a sine wave filter and the plurality of single bridge inverters, the plurality of single bridge inverters being adapted to operate at a high frequency so that harmonic components are extracted from the synthesized sine wave output.

4. The submersible pumping system as recited in claim 3, wherein the variable speed drive further comprises at least one parallel inductor, the at least one parallel inductor configured to operate with the plurality of single bridge inverters, the at least one parallel inductor configured to produce inductance, wherein the inductance generated is utilized to extract harmonic components from the synthesized sine wave output within the variable speed drive.

5. The submersible pumping system as recited in claim 2, wherein the variable speed drive comprises at least one step-up transformer integrated to the plurality of single bridge inverters to extract harmonics from the synthesized sine wave output, the at least one step-up transformer being configured to generate a leakage inductance utilized to extract harmonic components from the synthesized sine wave output.

6. A method for producing a sine wave output for a variable speed drive, comprising:

selecting a plurality of components of a variable speed drive, the act of selecting the plurality of components comprising selecting a plurality of single bridge inverters and at least one parallel inductor, the plurality of components being configured to provide a sine wave output; and integrating the plurality of components to filter harmonics from the sine wave output.

7. The method as in claim 6, wherein the act of integrating the plurality of components comprises the act of using an inductance generated by the at least one parallel inductor in combination with the plurality of single bridge inverters to filter out harmonic components in the sine wave output.

8. The method as in claim 6, wherein the act of selecting the plurality of components comprises selecting at least one step-up transformer.

9. The method as in claim 8, wherein the act of integrating the plurality of components comprises the act of using a leakage inductance as a filter inductance generated by the step-up transformer in combination with the plurality of single bridge inverters to extract harmonic components in the sine wave output.

10. The method as in claim 8, wherein the plurality of components comprise the plurality of single bridge inverters, the at least one parallel inductor and at least one step-up transformer, wherein the parallel inductors and the step-up transformer provide inductance that is used as filtering tool to extract harmonic components from the output of the variable speed drive.

11. The method as in claim 6, wherein the sine wave output is inputted into an electric motor.

12. A method for producing a sine wave output for a variable speed drive, comprising:

selecting a plurality of components of a variable speed drive, the plurality of components being configured to provide a sine wave output; and integrating the plurality of components to filter harmonics from the sine wave output, the act of integrating the plurality of components comprises operating the plurality of single bridge inverters at a high switching frequency to generate a high carrier frequency sine wave output, wherein the high carrier frequency sine wave output is filtered out by the plurality of components.

13. An apparatus designed to filter out harmonics from a wave output, comprising:

a variable speed drive having:

a power source; and a plurality of components coupled to the power source positioned within the variable speed drive, the plurality of components comprising:

a plurality of single bridge inverters;

at least one step-up transformer coupled to the plurality of single bridge inverters; and at least one parallel inductor coupled to the plurality of single bridge inverters and to the step-up transformer, wherein the plurality of components cooperate to filter harmonics from an output signal.

14. The apparatus as in claim 13, further comprises a sine wave filter coupled to the variable speed drive.

15. The apparatus as in claim 13, wherein the output signal is inputted into an electric motor.

16. The apparatus as in claim 14, wherein the sine wave filter is designed to extract harmonic components from the output signal produced by the variable speed drive.

17. The apparatus as in claim 13, wherein the plurality of single bridge inverters are configured to produce a high carrier frequency output signal.

18. The apparatus as in claim 17, wherein the sine wave filter is used to extract harmonic components from the high carrier frequency output signal.

19. The apparatus as in claim 13, wherein the at least one parallel inductor is configured to generate an inductance adapted to filter harmonic components in the output signal.

20. The apparatus as in claim 14, wherein the at least one parallel inductor is used in combination with the plurality of single bridge inverters and the sine wave filter to filter out harmonic components in the output signal.

21. The apparatus as in claim 13, wherein the at least one step-up transformer in combination with the plurality of single bridge inverters extract harmonic components in the output signal.

22. The apparatus as in claim 21, wherein the leakage inductance generated by the step-up transformer is used in combination with the plurality of single bridge inverters, the at least one parallel inductor and the sine wave filter to extract harmonic components in the output signal.

23. The apparatus as in claim 13, wherein the output signal is a sine wave voltage signal.

* * * * *